United States Patent [19]

Nerod

[11] 4,193,204

[45] Mar. 18, 1980

[54] ULTRAVIOLET LIGHT CURING APPARATUS FOR CONTAINERS AND THE LIKE

[75] Inventor: Irving Nerod, Geneva, N.Y.

[73] Assignee: American Can Company, Greenwich, Conn.

[21] Appl. No.: 968,015

[22] Filed: Dec. 11, 1978

[51] Int. Cl.[2] ..... F26B 3/30

[52] U.S. Cl. ..... 34/4; 34/21; 34/39; 34/105; 250/453; 250/503

[58] Field of Search ..... 250/494, 503, 504, 453; 34/4, 39, 40, 21, 104, 105, 106

[56] References Cited

U.S. PATENT DOCUMENTS

| | | | |
|---|---|---|---|
| 3,761,721 | 9/1973 | Altshuler et al. | 250/503 |
| 3,894,237 | 7/1975 | Choate et al. | 250/453 |
| 3,935,647 | 2/1976 | Aschberger | 34/105 |
| 4,029,967 | 6/1977 | Tetzlaff | 250/453 |
| 4,048,917 | 9/1977 | Skrypek et al. | 34/4 |

*Primary Examiner*—Larry I. Schwartz
*Attorney, Agent, or Firm*—Robert P. Auber; Ira S. Dorman; Stuart S. Bowie

[57] ABSTRACT

An ultraviolet light curing apparatus for curing inks and other coatings on cans and similar containers in which the cans are passed by a conveyor about a source of ultraviolet light and, as the cans rotate about the source, they receive virtually all the light rays from the ultraviolet light source by means of the ultraviolet light being reflected by reflectors rotating circumferentially around the light source.

7 Claims, 3 Drawing Figures

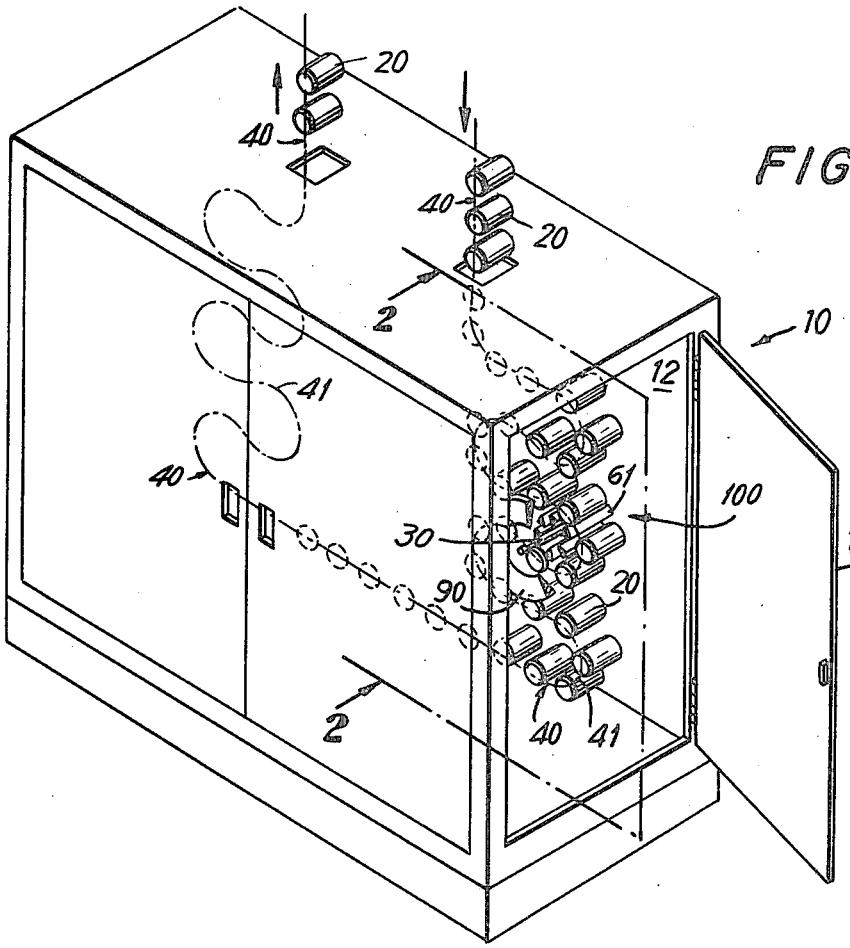
FIG. 1
FIG. 3
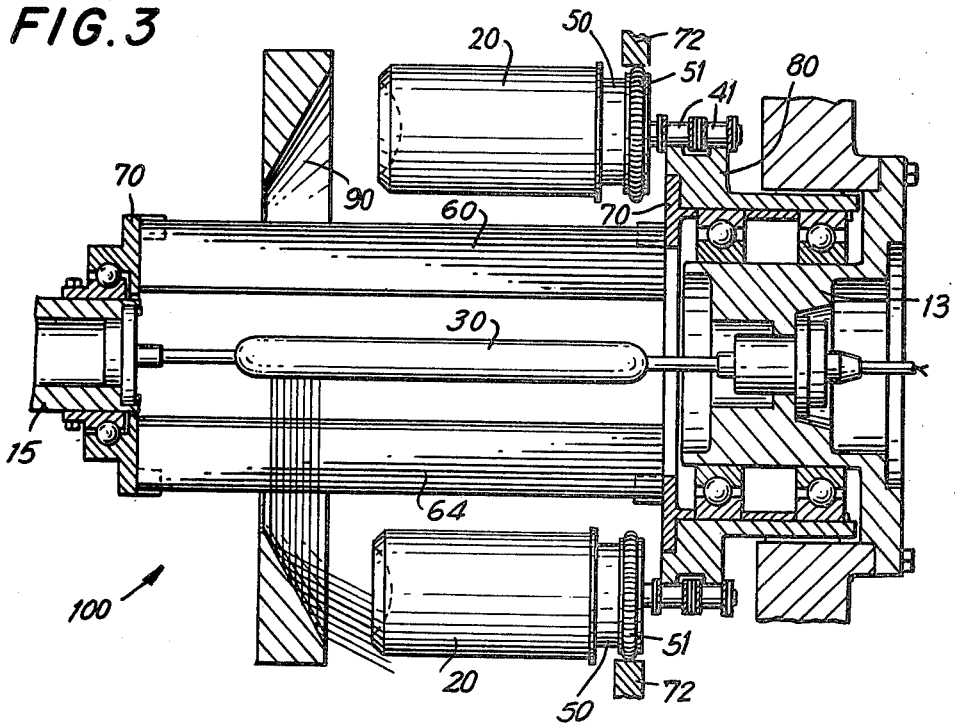

ULTRAVIOLET LIGHT CURING APPARATUS FOR CONTAINERS AND THE LIKE

BACKGROUND OF THE INVENTION

This invention relates to apparatus which utilizes ultraviolet light to cure inks and other ultraviolet-sensitive coatings on cans, containers and similar objects.

The use of ultraviolet light is not, of course, per se new.

U.S. Pat. No. 1,586,670 to Girard discloses an ultraviolet light for medical purposes in which the light is focused by means of prisms onto a conical pipe, thereby to be focused on a receiving surface.

Ultraviolet light sources have nbeen used to cure or treat a variety of surfaces. An early example may be found in U.S. Pat. No. 1,672,331 to Mailey in which ultraviolet light is used to cure varnished surfaces. A similar use of ultraviolet light is found in Brophy U.S. Pat. No. 2,020,296 which includes a source of ultraviolet about which a conveyor passes through 300°.

Jackson U.S. Pat. No. 3,934,500 discloses a multi-cylinder machine for printing on the surfaces of containers and ultraviolet light setting inks. One embodiment of the patent shows a fixed ultraviolet source having a shield or housing about which the containers pass. In another embodiment shown in that patent, each mandrel has an ultraviolet source with a curved reflector.

A more recent patent is U.S. Pat. No. 4,008,401 to Holloubek which discloses a curing system for tubular articles which are passed about a light source within a relfecting shield. In this patent, the tubular articles are stationary as they pass about the light source.

SUMMARY OF THE DISCLOSURE

The present invention is directed to a compact yet high speed apparatus for curing containers, such as cans, and similar objects which have on their surfaces ultraviolet-sensitive inks and coatings.

The device disclosed is designed to derive the maximum efficiency from each ultraviolet light source, thereby to save energy and, at the same time, to increase the speed at which the coatings on the objects are cured, therby increasing manufacturing efficiency.

In the apparatus, containers are conveyed around fixed ultraviolet light sources. A series of baffles or reflector segments are syncronized to revolve with the orbiting containers. The baffles or relfector segments serve to re-direct stray light onto the container surfaces to insure maximum ultilization of energy and to increase the rate of curing. The baffles or reflector segments serve to effect at least a partial focusing of the light rays.

In the embodiment disclosed, the containers are rotated a minimum of one turn in traveling around a fixed lamp and preferably at a distance approximately equal to the focal length (i.e., center of the lamp to the center of the container) of the lamp used other convenient distances may be used.

The apparatus includes multiples of baffles or reflector segments mounted on a common turret for rotating about a fixed ultraviolet lamp. In the arrangement show, the cans are exposed to the ultraviolet lamp and the system is designed to capture the strongest part of the lamp output and, in addition, to focus stray rays on the surface of the can without using a conventional elliptical type reflector. In this arrangement it is possible to cure multiples of cans and other containers or objects at high speed while traveling around a fixed lamp.

It is also possible with the present apparatus to increase the ultraviolet dosage by adding multiple units of the assembly within an enclosure and to expose the containers or other objects to ultraviolet radiation in a repeat pattern.

DESCRIPTION OF THE DRAWINGS

FIG. 1 is a view of the ultraviolet processing unit in perspective whith certain parts omitted for clarity.

FIG. 3 is a sectional view taken along the lines 3—3 of FIG. 2 showing in detail one of the curing stations.

DETAILED DESCRIPTION

Figure 2:
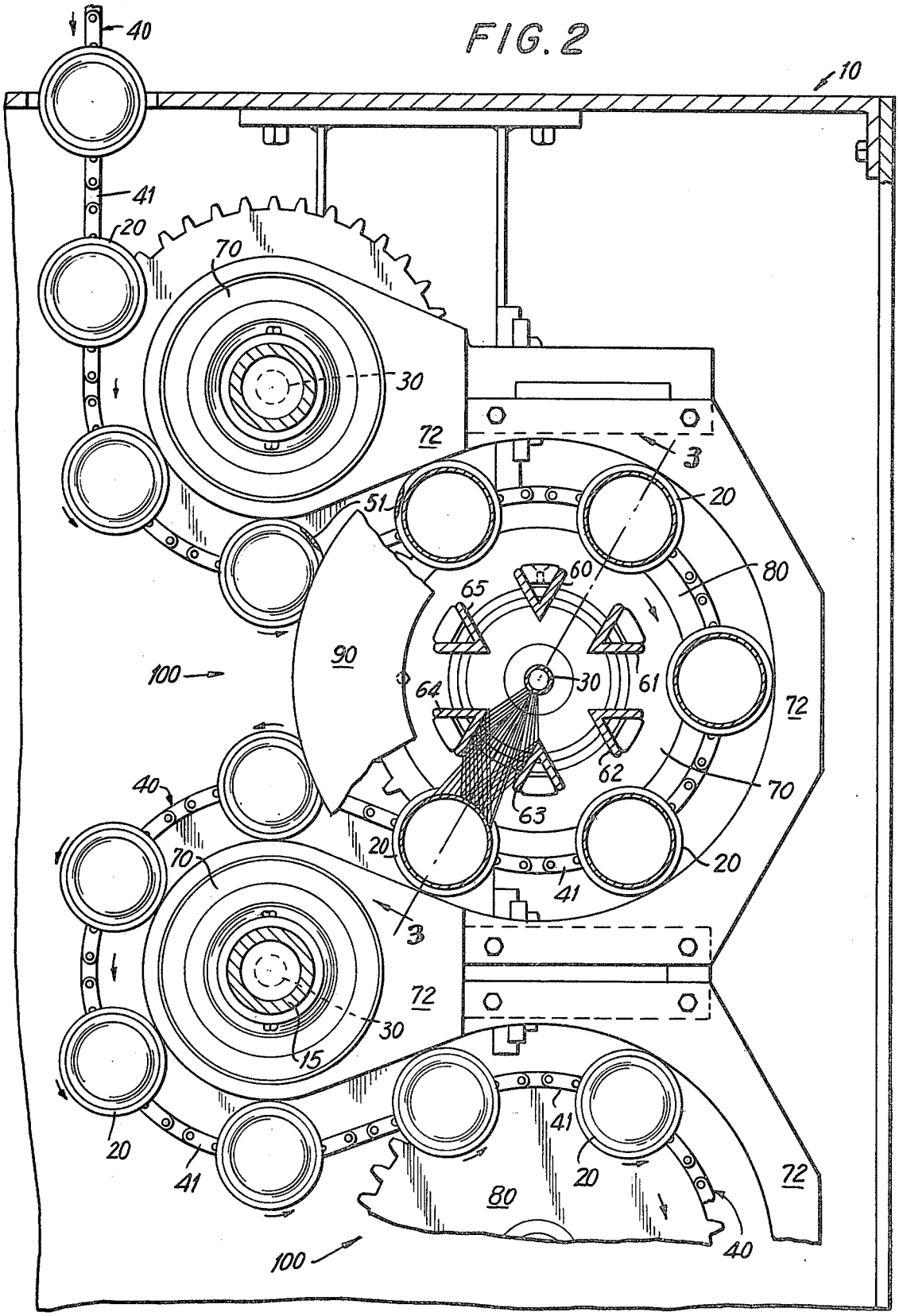
FIG. 2 is an enlarged sectional view in elevation of the container conveyor system and curing stations within the ultraviolet processing unit along lines 2—2 of FIG. 1.

The apparatus of the invention includes an ultraviolet (U.V.) processing unit or oven 10 having a side door 11 for access to the interior.

Arranged on the rear wall 12 of the unit 10 are a series of ultraviolet lights generally designated 30. Objects, such as cans 20, are mounted on mandrels 50 which are fastened to chain 41 of conveyor 40, so that the cans 20 are conveyed from the manufacturing line in the direction of the arrows as shown in FIG. 1. The number of lights 30 within the unit is essentially a matter of choice and it will be understood that more rapid curing can be effected by having a greater number of lights. The lights 30 are affixed to a stationary supports 13, 15 attached to the frame of unit 10 so that each light 30 is perpendicular to wall 12.

The fixed ultraviolet lights 30 are, in this embodiment, elongated ultraviolet arc lamps. The distance between lamp 30 and the center of each container 20 is preferably equal to the focal length of lamp 30. Throughout the travel of the cans 20 about the U.V. lamp 30, the longitudinal axis of the containers 20 are preferably substantially parallel to the longitudinal axis of the lamps 30.

As the cans 20 pass through unit 10, they are rotated once in their approximately 260° passage about each light 30. This rotation is caused by fixed cams, such as cam 72 bearing against spring 51 which surround the base of each mandrel 50, as shown in FIG. 3.

Arranged in equal distance relationship around each lamp 30 are a series of baffles or segmented V-shaped light reflectors 60–65 which are mounted on a turret 70 driven by gear 80 for rotation about the lamp 30 in syncronization with the revolving containers 20 to continuously focus stray light onto the surfaces thereof during passage thereof around light 30, as indicated in FIGS. 2 and 3.

Each lamp assembly 30 also has an annular concave end reflector 90 mounted adjacent the ends of the cans 20 for reflecting light from lamps 30 thereon.

Because the containers 20 are rotated at least once about their axis as they traverse the arc around the lamps 30, and reflectors 90 focus light on the can bottoms, the entire exterior surface of the container walls are exposed to direct radiation from the lamps 30. Further, an important advantage of this invention are the rotating reflector segments 60–65, which are syncronized with the movement of the containers 20 and positioned so that they focus all available light onto the side surfaces of the containers, thereby increasing the efficiency of the U.V. curing, as shown in FIG. 2. Additionally, the rotating reflector segments 60–65 serve to keep the air surrounding the lamp in movement, thereby assisting in dissipation of heat.

It will be understood that each assembly 100 shown in FIGS. 1 and 2 has the construction of the assembly shown in detail in FIG. 3.

In the multiple assembly system such as that shown, it is possible to cure in multiple stages and to control the degree of curing by the ultraviolet light sources. Such an arrangement also makes it possible to move containers or other objects at a higher rate of speed through the curing system than would otherwise be possible. This arrangement also makes it possible to utilize a U.V. processing unit or oven greatly reduced in size and to use relatively small lamps mounted horizontally in a vertically stacked relationship, thereby permitting the U.V. unit to be designed to suit floor space.

I claim:

1. A method for continuously curing ultra-violet-curable coated articles comprising:

(a) passing said articles about an ultraviolet light source;

(b) rotating the surfaces of the articles relative to the light source as the articles pass thereabout (c) rotating reflector means about the light source in substantially synchronous relation to the articles, thereby focusing the light continuously on the surfaces of the articles during passage thereof about the light source.

2. The invention of claim 1 wherein the articles are containers.

3. The invention of claim 2 wherein the containers are coated with an ultra-violet-curable ink.

4. Apparatus for continuously curing ultra-violet light curable coated articles comprising:

(a) A fixed source of ultra-violet light;

(b) Conveyor means for conveying the articles about the light;

(c) Means for rotating the surfaces of the articles relative to the light source as the articles pass thereabout;

(d) reflector means disposed between the light source and the articles for focusing the light on the surfaces of the articles during the passage thereof about the light source;

(e) means for rotating the reflector means around the light source in substantial synchronism with the rotation of the articles about such source.

5. The invention of claim 4 wherein the apparatus includes at least two spaced apart light sources, and the conveyor means is operable to pass the articles sequentially thereabout.

6. The invention of claim 4 wherein the reflector means comprises a plurality of reflectors spaced about the light source.

7. The invention of claim 4 wherein the articles are containers.

* * * * *